US005769096A

United States Patent [19]

Okumoto

[11] Patent Number: 5,769,096

[45] Date of Patent: Jun. 23, 1998

[54] DEVICE FOR TRIMMING SHREDDED TOBACCO LAYER FORMED IN CIGARETTE MANUFACTURING MACHINE

[75] Inventor: Yutaka Okumoto, Tokyo, Japan

[73] Assignee: Japan Tobacco Inc., Tokyo, Japan

[21] Appl. No.: 865,190

[22] Filed: May 29, 1997

[30] Foreign Application Priority Data

May 29, 1996 [JP] Japan ..... 8-135068

[51] Int. Cl.[6] ..... A24C 5/39

[52] U.S. Cl. ..... 131/84.4; 131/84.1

[58] Field of Search ..... 131/84.1, 84.2, 131/84.3, 84.4

[56] References Cited

U.S. PATENT DOCUMENTS

| | | | |
|---|---|---|---|
| 3,712,160 | 1/1973 | Preston | 131/84.4 |
| 4,210,159 | 7/1980 | Quarenghi | 131/210 |
| 4,485,826 | 12/1984 | Holzangel | 131/84 C |
| 5,526,826 | 6/1996 | Heitmann | 131/84.4 |

FOREIGN PATENT DOCUMENTS

| | | | |
|---|---|---|---|
| 645098A | 3/1995 | European Pat. Off. | 131/84.4 |
| 2440980 | 3/1976 | Germany | 131/84.4 |
| 2150410 | 7/1985 | United Kingdom | 131/84.4 |
| 2263616 | 8/1993 | United Kingdom | 131/84.4 |

*Primary Examiner*—Aaron J. Lewis
*Assistant Examiner*—Charles W. Anderson
*Attorney, Agent, or Firm*—Birch, Stewart, Kolasch & Birch, LLP

[57] ABSTRACT

A device for trimming a shredded tobacco layer in a cigarette manufacturing machine comprises a pair of trimming disks rotatably arranged, a peeler wheel rotatably arranged under the trimming disks, the peeler wheel having a peeling blade formed at the peripheral edge thereof to scrape surplus shredded tobacco off the shredded tobacco layer in cooperation with the trimming disks, and an air nozzle for ejecting compressed air to the scraped-off surplus shredded tobacco, thereby deflecting and separating the surplus shredded tobacco.

6 Claims, 6 Drawing Sheets

DEVICE FOR TRIMMING SHREDDED TOBACCO LAYER FORMED IN CIGARETTE MANUFACTURING MACHINE

BACKGROUND OF THE INVENTION

1. Field of the Invention

The present invention relates to a device for trimming a shredded tobacco layer sucked on a suction band, thereby adjusting the thickness of the shredded tobacco layer when a tobacco rod is formed continuously in a cigarette manufacturing machine.

2. Description of the Related Art

A trimming device for shredded tobacco has trimming disks rotatably arranged under a suction band of a cigarette manufacturing machine, and a rotary brush of metal which rotates kept in contact with the lower surfaces of the trimming disks. The trimming disks and the rotary brush cooperate with each other to adjust a shredded tobacco layer sucked on the lower surface of the suction band to a predetermined thickness. More specifically, the shredded tobacco layer is adjusted to a thickness corresponding to a distance between the trimming disks and the suction band, and surplus shredded tobacco located under the trimming disks is removed by the rotary brush.

The rotary brush has a plurality of scraping fins which are disposed equally spaced apart from one another on the periphery of the rotary brush. Each scraping fin has a blade at the tip thereof. As the rotary brush rotates, each blade periodically comes in contact with the lower surface of the trimming disks. Thus, a portion of the shredded tobacco layer which would otherwise pass under the trimming disks, that is, the surplus shredded tobacco is scraped off by the plurality of fins of the rotary brush. The scraped-off shredded tobacco is thereafter collected and reused to form a shredded tobacco layer.

Recently, traveling speed of the suction band, that is, transportation speed of the shredded tobacco layer tends to be more and more increased in order to enhance productivity in manufacturing a tobacco rod by a cigarette manufacturing machine. Under the circumstances, the rotary brush of the trimming device also needs to be rotated at high speed, in order to steadily adjust the thickness of the shredded tobacco layer.

When the rotation speed of the rotary brush is increased, the respective scraping fins however beat the surplus shredded tobacco strongly, so that the scraped-off shredded tobacco is broken into fragments badly. Thus, the collected shredded tobacco is too small in particle size to be reused.

Further, the rotary brush rotating at high speed scatters the surplus shredded tobacco without order, so that the surplus shredded tobacco can not be collected easily.

SUMMARY OF THE INVENTION

The object of the present invention is to provide a trimming device for shredded tobacco layer capable of not only reducing the fragmentation of the shredded tobacco but also collecting the shredded tobacco easily after trimming and suitable for high speed operation of a cigarette manufacturing machine.

The object is achieved by a trimming device according to the present invention, the trimming device comprises: a trimming disk rotatably arranged in a vicinity of a suction band which forms and transports a shredded tobacco layer, the trimming disk continuously cutting into the shredded tobacco layer during the rotation of the trimming disk, thereby dividing the shredded tobacco layer into a required layer portion and a surplus portion; and removing means for removing the surplus portion of the shredded tobacco layer in cooperation with the trimming disk, the removing means including scraping means f or scraping the surplus portion off the trimming disk, the scraping means having a peeling blade arranged to move keeping contact with the trimming disk, and deflecting means for deflecting the removed surplus shredded tobacco in the direction deviating from the trimming disk, the deflecting means including air ejecting means for ejecting a compressed air flow to the removed surplus shredded tobacco.

According to the trimming device described above, the surplus portion of the shredded tobacco layer is removed by the peeling blade like peel is peeled off. Therefore, the surplus shredded tobacco will not be subjected to excessively large impact, and the fragmentation of the surplus shredded tobacco is largely reduced. As a result, rate of reuse of the surplus shredded tobacco is increased, and productivity of the cigarette manufacturing machine can be enhanced. Further, the scraped-off surplus shredded tobacco is guided by the compressed air flow and suitably deviates from the trimming disk side in a desired direction, thereby to be prevented from being scattered.

Specifically, the scraping means includes a rotatable wheel member, the wheel member has a peripheral edge formed as the peeling blade, and the peeling blade extends continuously in the peripheral direction of the wheel member. In this case, the peeling blade continuously scrapes the surplus shredded tobacco off the trimming disk during the rotation of the wheel member.

The air ejecting means may includes an air nozzle located beside the wheel member to eject compressed air along the plane of rotation of the peeling blade. By this formation, the scraped-off surplus shredded tobacco is guided by the air flow in the direction deviating from the trimming disk side.

The wheel member may be provided with a surface which serves to guide the scraped-off surplus shredded tobacco.

In order to reduce the weight of the wheel member, the wheel member may be provided with a plurality of openings in the peripheral direction thereof. In this case, it is preferable to have an air flow generated to flow through the openings to the side of the peeling blade. The air flow serves to prevent the surplus shredded tobacco from passing through the openings.

The peeling blade moves in the direction intersecting the transportation direction of the shredded tobacco layer when the wheel member rotates. In this arrangement, the peeling blade can easily cut into the surplus portion of the shredded tobacco layer.

Further scope of applicability of the present invention will become apparent from the detailed description given hereinafter. However, it should be understood that the detailed description and specific example, while indicating preferred embodiment of the invention, are given by way of illustration only, since various changes and modifications within the sprit and scope of the invention will be become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
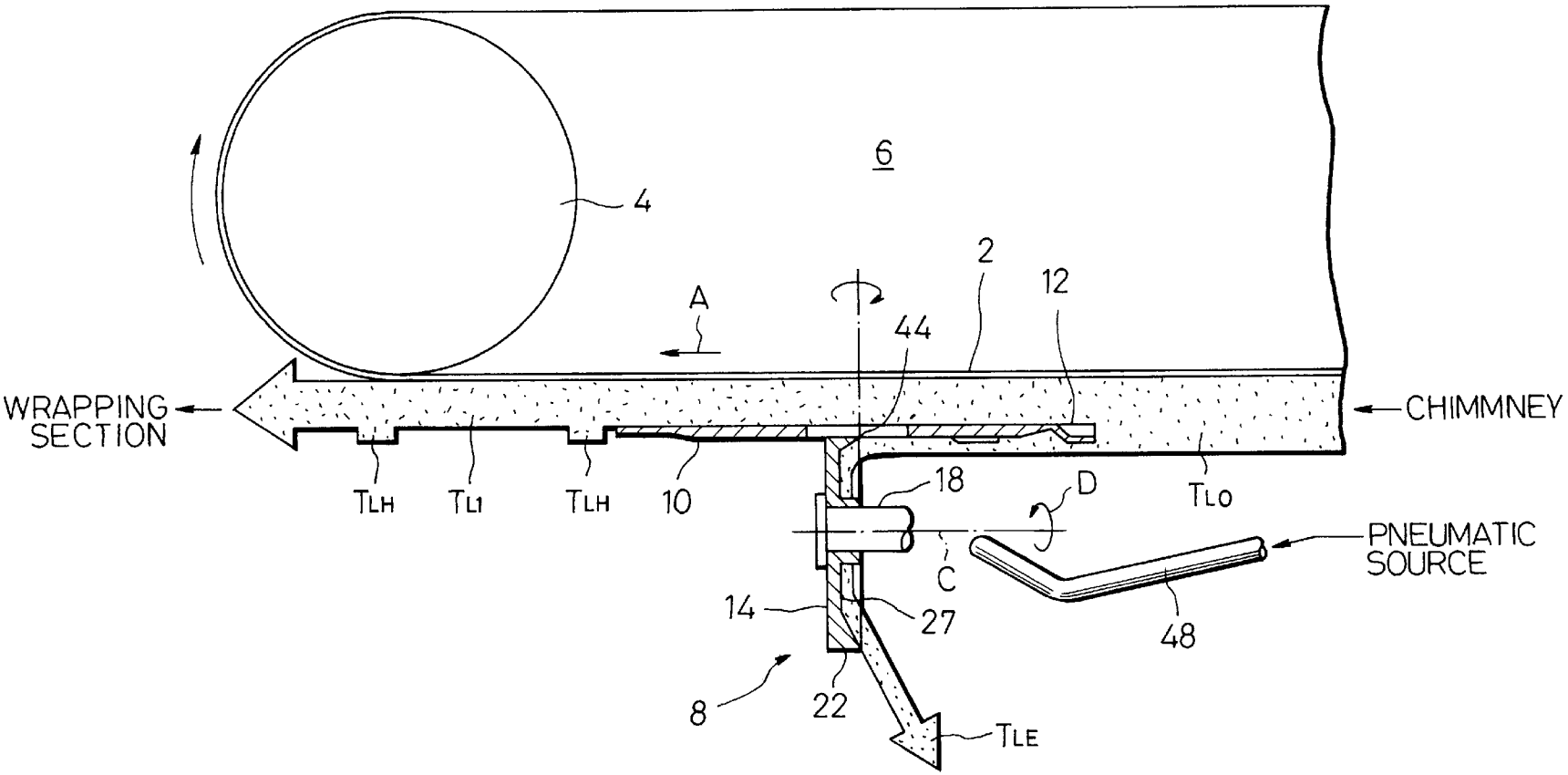
FIG. 1 is a schematic structural view showing a part of a cigarette manufacturing machine including a trimming device.

FIG. 1 shows a part of a cigarette manufacturing machine including a device for trimming a shredded tobacco layer. As known, the cigarette manufacturing machine is provided with an endless suction band 2, which is extended around a pair of band rollers 4. As the band rollers 4 rotate, the suction band 2 travels at a constant speed in the direction indicated by an arrow A in FIG. 1 within a perpendicular plane. It is to be noted that only one of the band rollers 4 is shown in FIG. 1.

The suction band 2 is disposed in a suction chamber 6. The suction chamber 6 generates an air flow flowing upward from under the suction band 2. At the side of the band roller not shown is provided a chimney (not shown) directly under the suction band 2. Shredded tobacco supplied into the chimney is blown up with air by sucking force of the suction chamber 6 and sucked onto the lower surface of the suction band 2 in the form of a layer. Thus, a shredded tobacco layer $T_{LO}$ is formed on the portion of the suction band 2 which has passed through the chimney. The shredded tobacco layer $T_{LO}$ is transported with the suction band 2, and then at the position of the band roller 4, taken off the suction band 2 by a shoe (a scraper) not shown and supplied onto paper in a wrapping section of the cigarette manufacturing machine.

Under the suction band 2 is provided a trimming device 8 in the vicinity of one of the band rollers 4. The trimming device 8 has a pair of trimming disks 10 disposed on the left and right sides of the suction band 2 relative to its traveling direction. The Trimming disks 10 are made of metal and disposed on the same horizontal plane. In FIG. 1, only an axis of a rotary shaft on which one of the trimming disks 10 is mounted is shown.

Figure 2:
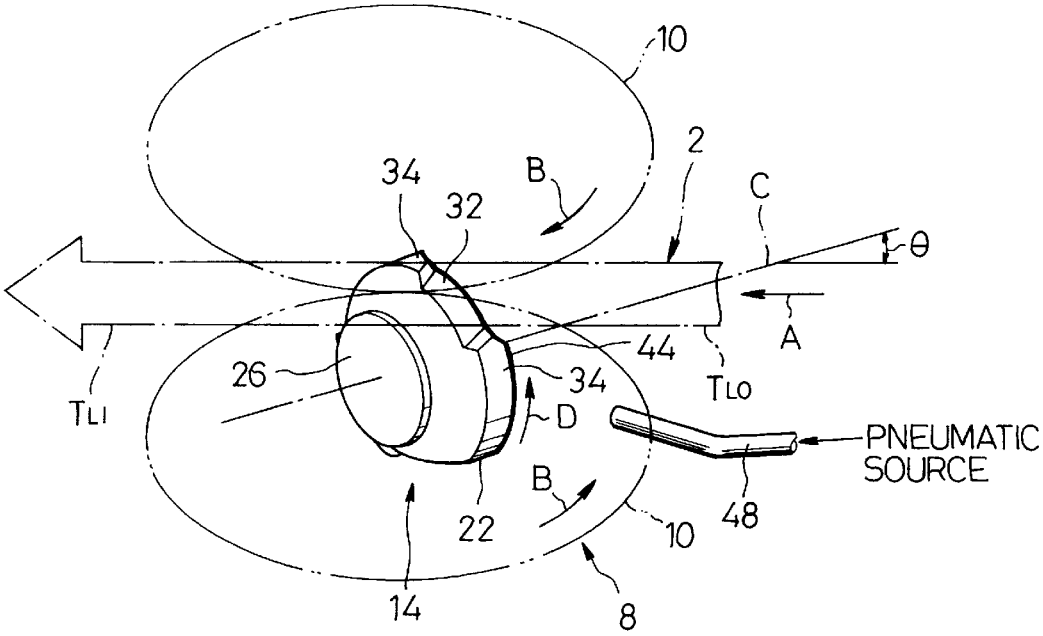
FIG. 2 is a perspective view of a trimming device of FIG. 1.

More specifically, as shown in FIG. 2, the pair of trimming disks 10 are disposed on both sides of the suction band 2, and the peripheral edge portions of the trimming disks 10 are close to each other under the suction band 2, with a perpendicular plane including a center line of the suction band 2 sandwiched therebetween.

The pair of trimming disks 10 are rotated in opposite directions. The directions of their rotations are indicated by arrows B in FIG. 2. It is to be noted that after coming close to each other, the peripheral edge portions of the trimming disks 10 move in the same direction with the transportation direction A of the aforementioned shredded tobacco layer $T_{LO}$.

The pair of the trimming disks 10 have a plurality of pockets 12 at their peripheral edge portions, respectively (FIG. 1). The pockets 12 are disposed equally spaced apart from one another in the peripheral direction of each trimming disk 10. It is so provided that while the pair of trimming disks 10 are rotating, each pocket 12 of one of the trimming disks 10 periodically meets a corresponding pocket 12 of the other trimming disk 10 under the suction band 2.

The trimming device further comprises a peeler wheel 14 made of metal. The peeler wheel 14 is disposed directly under the pair of trimming disks 10, or more specifically, directly under the area where the peripheral edge portions of the pair of trimming disks 10 are close to each other. The peeler wheel 14 rotates within a perpendicular plane, that is, the peeler wheel 14 has a horizontal axis of rotation C. The pair of trimming disks 10 have, on the other hand, a perpendicular axis of rotation, respectively.

As seen in FIG. 2, the axis of rotation C of the peeler wheel 14 is not parallel to the transportation direction A of the shredded tobacco layer $T_{LO}$ but oblique to the transportation direction A by an angle θ (42° , for example). As shown in FIG. 1, the peeler wheel 14 is connected to an end of a rotary shaft 18. When torque is supplied from a power transmission system (not shown) to the rotary shaft 18, the peeler wheel 14 is rotated along with the rotary shaft 18 in the direction D indicated by an arrow in FIG. 1. The power transmission system supplies torque also to the pair of band rollers 4 of the suction band 2 and the pair of trimming disks 10.

The direction of rotation D of the peeler wheel 14 is so arranged that a portion of the peripheral surface of the peeler wheel 14 which is located directly under the trimming disks 10, that is, the top face of the peeler wheel 14 moves approaching the transportation direction A of the shredded tobacco layer $T_{LO}$. In other words, the top face of the peeler wheel 14 moves obliquely intersecting the shredded tobacco layer $T_{LO}$ from the upstream side to the downstream side relative to the transportation direction A of the shredded tobacco layer $T_{LO}$.

Figure 3:
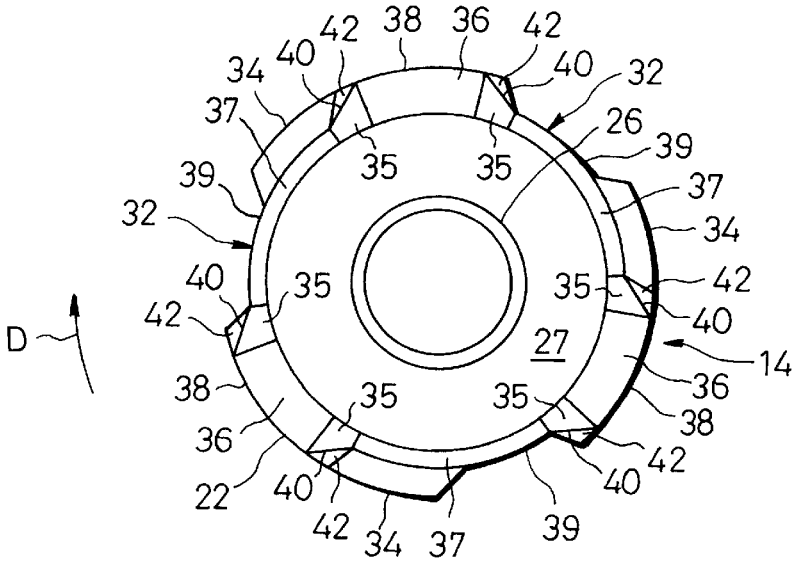
FIG. 3 is a front view of a peeler wheel of FIG. 2 as seen from the side of a peeling blade.

FIG. 3 shows the peeler wheel 14 in detail. An end face of the peeler wheel 14 which is disposed to face the transportation direction A of the shredded tobacco layer $T_{LO}$ is formed with a hub 26 at the center thereof. The hub 26 is provided for mounting the peeler wheel 14 at one end of the aforementioned rotary shaft 18. An annular recession 27 is formed at the end face of the peeler wheel 14 around the hub 26. By provision of the recession 27, the peripheral portion of the peeler wheel 14 is formed as a peeling rim 22.

The peripheral surface of the peeler wheel 14, that is, the outer peripheral surface of the peeling rim 22 is formed with a plurality of transverse recesses 32. The transverse recesses 32 are disposed equally spaced apart from one another in the peripheral direction of the peeling rim 22, so that the peeling rim 22 has a plurality of land portions 34 at its outer peripheral surface. In the case that the trimming disks 10 have respectively three pockets 12, the peeling rim 22 is formed with three transverse recesses 32 and three land portions 34. As seen in FIG. 2, the bottom surface of each transverse recess 32 forms a part of a same circular face.

As the peeler wheel 14 rotates, the transverse recess 32 and the land portion 34 of the peeling rim 22 16 pass the area where the peripheral edge portions of the pair of trimming disks 10 are close to each other, alternately and periodically. At that time, each transverse recess 32 periodically meets a corresponding pair of pockets 12 formed at the pair of trimming disks 10. Thus, the pair of trimming disks 10 can rotate without their pockets 12 interfering with the peeling rim 22. More specifically, in order to prevent the interference with the pockets 12, each transverse recess 32 is formed, as seen in FIG. 2, oblique to the axis of rotation C of the peeler wheel 14 by a predetermined angle, assuring that an open end of the transverse recess 32 opening to the side of aforementioned end face of the peeler wheel 14 precedes the opposite open end thereof with respect to the direction of rotation D of the peeler disk 14. Each transverse recess 32 has a predetermined width in the peripheral direction of the peeler rim 22, and a depth equal to the distance between the upper surface of the trimming disk 10 and the lower surface of the pocket 12. The aforementioned oblique formation of each transverse recess 32 allows the transverse recess 32 to have a minimum width.

As seen in FIG. 1, the inner peripheral surface of the peeling rim 22 is formed as a taper surface, through which the peripheral edge of the peeling rim 22 and the recession 27 are connected. In FIG. 3, portions of the taper surface which correspond to the land portions 34 and transverse recesses 32 are designated by reference numerals 36 and 37, respectively.

The taper surface portions 36 provide acute blades 38 at the peripheral edges of the land portions 34, respectively, and the taper surface portions 37 provide acute blades 39 at the edges of the bottom surfaces of the transverse recess 32, respectively. Further, as seen in FIG. 3, each taper surface portions 36 and 37 adjacent to each other in the peripheral direction of the peeling rim 22 are connected through a slant 35. Each slant 35 is connected through a triangular chamfer 42 to the outer peripheral surface of the land portion 34 and the side wall of the transverse recess 32. Therefore, each blades 38 and 39 adjacent to each other are connected through an edge of the triangular chamfer 42, which is also formed as a blade 40.

Figure 4:
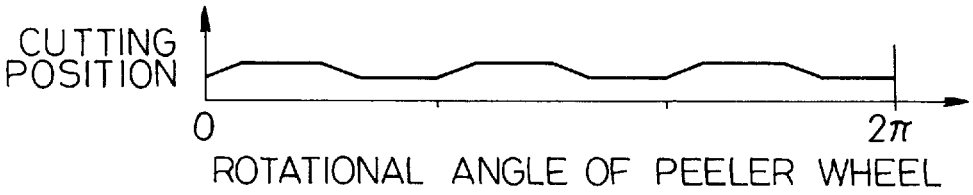
FIG. 4 is a graph showing a relation between an angle of rotation of the peeler wheel and a cutting position of the peeling blade.

The blades 38, 39 and 40 constitute a peeling blade 44 continuously extending in the peripheral direction of the peeling rim 44. As seen in FIG. 3, the distance between the peeling blade 44 and the axis of the peeling rim 22 varies periodically in the peripheral direction of the peeling rim 22. Therefore, when the peeling blade 44 passes under the pair of trimming disks 10 during the rotation of the peeling wheel 14, the cutting position of the peeling blade 44 varies periodically in the radial direction of the peeling wheel 14, as shown in FIG. 4.

The aforementioned pair of trimming disks 10 and the peeler wheel 14 are supported in the manner that they can be moved in connection with each other in the perpendicular direction, or instead, the suction band 2 is so provided that a portion thereof located over the pair of trimming disks 10 can be raised and lowered. Thus, the distance between the suction band 2 and the pair of trimming disks 10 is adjustable.

Figure 5:
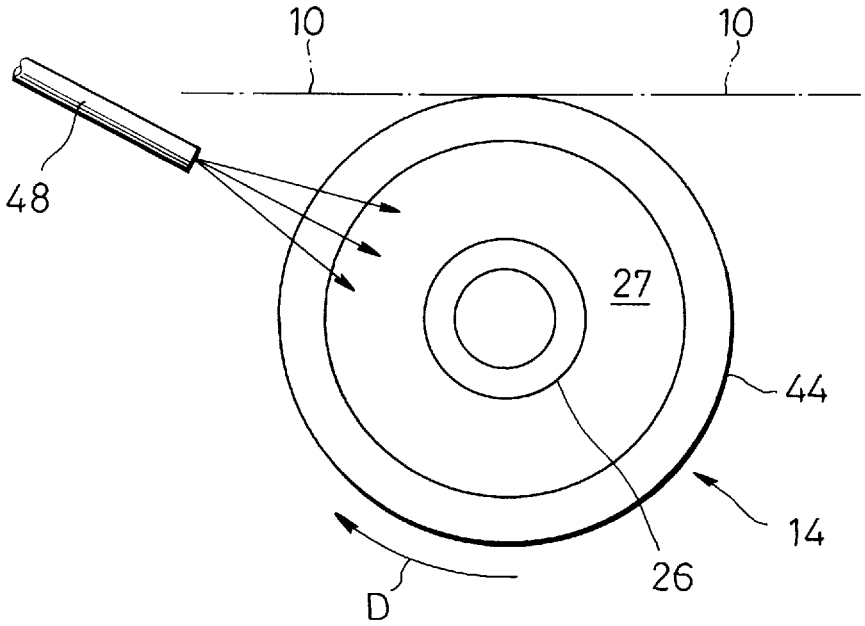
FIG. 5 is a view showing a relation between the peeler wheel and an air nozzle.

As shown in FIGS. 1 and 2, an air nozzle 48 is provided in the vicinity of the peeler wheel 14. The air nozzle 48 is connected to a pneumatic source and ejects compressed air supplied from the pneumatic source toward the peeler wheel 14. More specifically, the air nozzle 48 ejects the compressed air from the rear side of the peeler wheel 14 along the plane of rotation of the peeling blade 44. As shown in FIG. 5, the ejecting direction of the compressed air is so arranged to intersect the axis of the peeler wheel 14 obliquely from the upper side to the lower side thereof. It is to be noted that in FIG. 5, the peeling blade 44 is shown as a simple circle for convenience'sake in drawing.

The operation of the aforementioned trimming device 8 will be described hereinafter.

When the shredded tobacco layer $T_{L0}$ is formed on the suction band 2, the pair of trimming disks 10 and the peeler wheel 14 are rotating. The peeler wheel 14 rotates with its peeling blade 44 kept in contact with the lower surfaces of the peripheral edge portions of the trimming disks 10.

When the suction band 2 having the shredded tobacco layer $T_{L0}$ sucked thereon travels forth and passes the trimming device 8, the peripheral edge portions of the pair of trimming disks 10 cut into the shredded tobacco layer $T_{L0}$ and divide the shredded tobacco layer TL0 into upper and lower portions. At the same time, the peeling blade 44 of the peeler wheel 14, which rotates keeping contact with the lower surfaces of the peripheral edge portions of the trimming disks 10 (including the lower surfaces of the pockets 12), scrapes the lower portion of the shredded tobacco layer $T_{L0}$ off the lower surfaces of the trimming disks 10, as shown in FIG. 1. Thus, the surplus portion of the shredded tobacco layer $T_{L0}$ is removed from the shredded tobacco layer $T_{L0}$ in the form of a layer, like peel is peeled off. Then, the surplus shredded tobacco $T_{LE}$ reaches the recession 27 of the peeler wheel 14, where the surplus shredded tobacco $T_{LE}$ is deflected downward owing to the rotation of the recession 27, and then the surplus shredded tobacco $T_{LE}$ is discharged from the peripheral portion of the peeler wheel 14.

At that time, the compressed air ejected from the air nozzle 48 toward the recession 27 of the peeler wheel 14 applies a downward urging force to the surplus shredded tobacco $T_{LE}$ in the recession 27. Thereby, the surplus shredded tobacco $T_{LE}$ is prevented from staying in the recession 27, and is securely discharged from the periphery of the peeler wheel 14. The surplus shredded tobacco $T_{LE}$ is thereafter collected by collecting means (not shown) and reused to form a shredded tobacco layer $T_{L0}$.

After the shredded tobacco layer $T_{L0}$ passes the pair of trimming disks 10, the shredded tobacco layer remaining on the lower surface of the suction band 2, that is, the trimmed shredded tobacco layer $T_{L1}$ is adjusted in its thickness correctly to the distance between the trimming disks 10 and the suction band 2. On the other hand, while the pair of trimming disks are rotating, a pair of pockets 12 meet each other periodically in the shredded tobacco layer $T_{L0}$ as mentioned above, so that thickened portions $T_{LH}$ having a thickness increased by an amount corresponding to the content of the pair of pockets 12 are periodically formed to the trimmed shredded-tobacco layer $T_{L1}$ (FIG. 1). The thickened portions $T_{LH}$ are formed spaced apart from each other by a distance corresponding to twice a length of a cigarette, for example.

The shredded tobacco layer $T_{L1}$ is thereafter supplied from the suction band 2 to the wrapping section of the cigarette manufacturing machine as mentioned above. The shredded tobacco layer $T_{L1}$ supplied to the wrapping section is wrapped in paper (not shown) as known, whereby a tobacco rod is continuously formed. The formed tobacco rod is supplied from the wrapping section to a cutting section of the cigarette manufacturing machine, where the tobacco rod is cut at the center of each portion corresponding to the aforementioned thickened portion, thereby to be separated into double-cigarettes.

As described above, in the trimming device 8, the shredded tobacco layer $T_{L0}$ is trimmed in the manner that the surplus shredded tobacco $T_{LE}$ is removed from the shredded tobacco layer $T_{LO}$ like peel is peeled off. Therefore, the surplus shredded tobacco $T_{LE}$ will not be subjected to a large impact, so that the fragmentation of the surplus shredded tobacco can be reduced largely. Further, owing to the application of the compressed air flow ejected from the air nozzle 48, the surplus shredded tobacco $T_{LE}$ is guided along the recession 27 and securely discharged downward from the periphery of the peeler wheel 14. Therefore, the surplus shredded tobacco is not scattered around the peeler wheel 14 and can be collected easily. As a result, the rate of reuse of the collected surplus shredded tobacco $T_{LE}$ is enhanced, while the transportation speed of the shredded tobacco layer is allowed to be increased. Therefore, the production efficiency of tobacco rod can be enhanced.

A second embodiment of the trimming device 80 is shown in FIGS. 6 to 10. It is to be noted that in the following description of the trimming device 80, members and portions having functions similar to those of the members and portions of the aforementioned trimming device 8 are designated by the same reference numerals, while the explanations of those members and portions are omitted.

Figure 6:
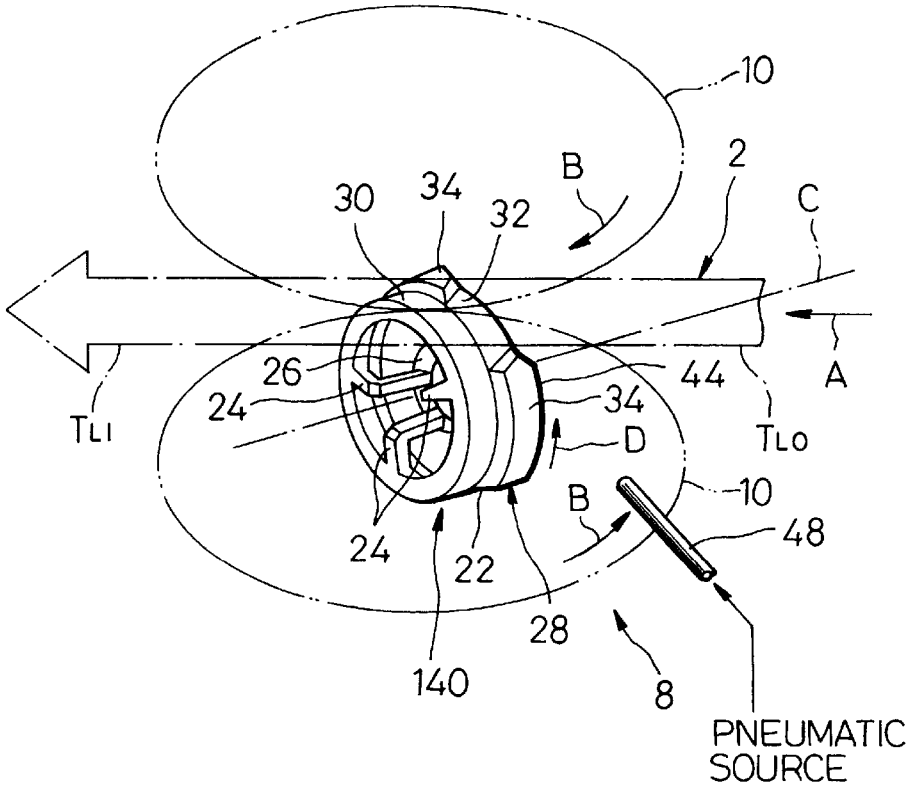
FIG. 6 is a perspective view showing a trimming device according to a second embodiment.

As shown in FIG. 6, the trimming device 80 has a peeler wheel 140 instead of the peeler wheel 14. The peeler wheel 140 has a peeling rim 22 and a ring portion 30. The ring portion 30 projects from the peeling rim 22 to the side opposite to a peeling blade 44. The radius of the ring portion 30 is equal to or smaller than a distance between an axis of the peeling rim 22 and the bottom surface of the transverse recess 32.

Figure 7:
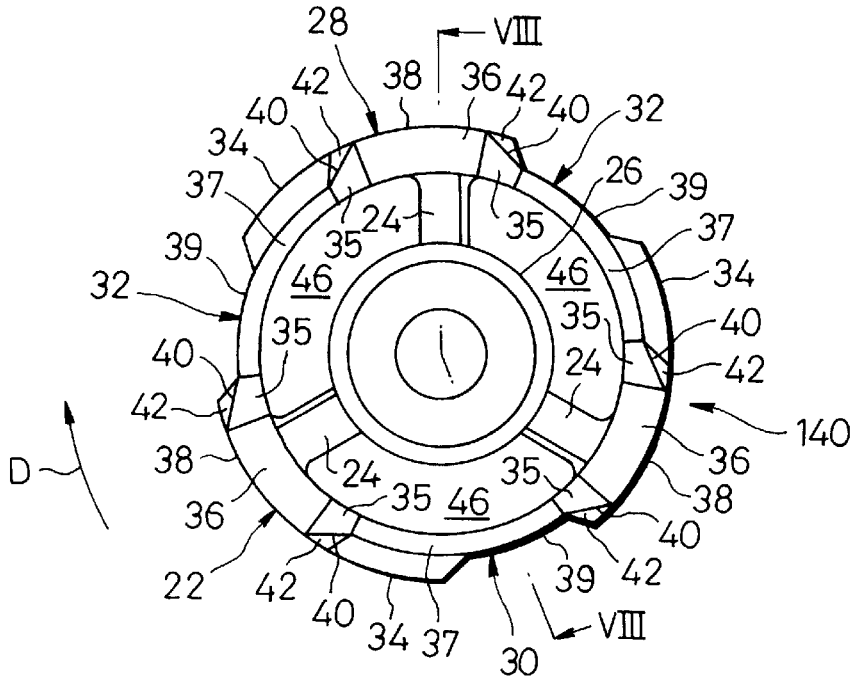
FIG. 7 is a front view of the peeler wheel of FIG. 6 as seen from the side of the peeling blade thereof.
Figure 8:
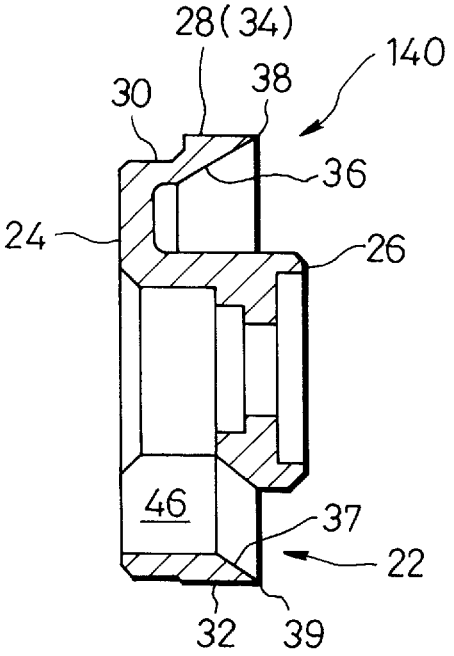
FIG. 8 is a sectional view of the peeler wheel taken along a line VIII—VIII of FIG. 7.

The ring portion 30 and a hub 26 are connected by three spokes 24. As seen in FIGS. 7 and 8, three openings are provided between the spokes 24 around the hub 26, thereby reducing the weight of the peeler wheel 140.

Figure 9:
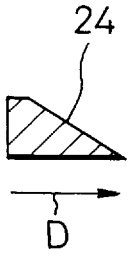
FIG. 9 is a cross sectional view of a spoke of the peeler wheel.

Further, as shown in FIG. 9, the front portion of each spoke is so formed as to have a wedge-shaped profile in the direction of rotation D of the peeler wheel 140.

Figure 10:
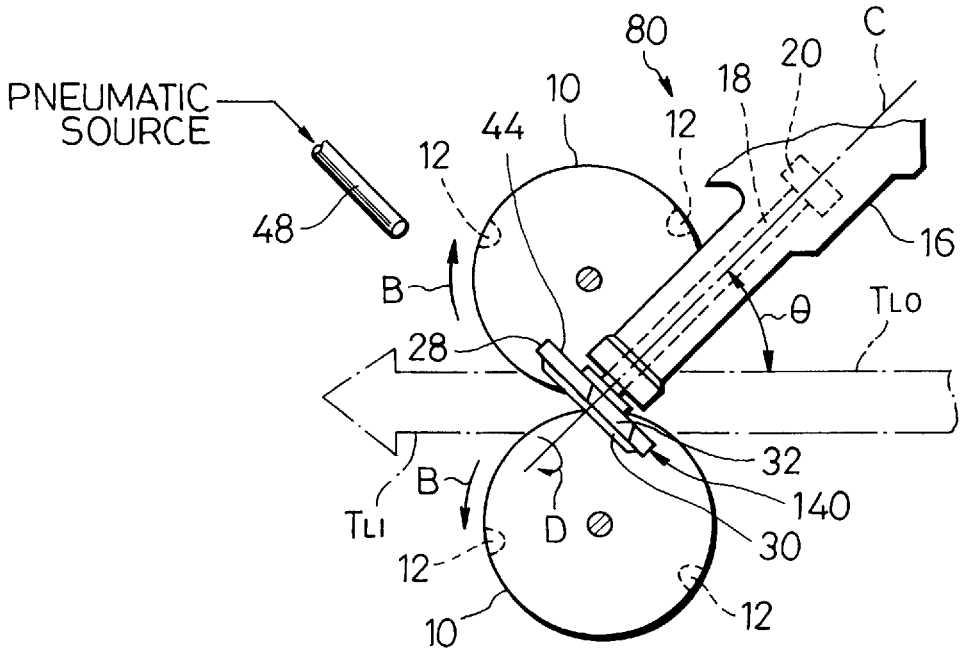
FIG. 10 is a bottom view of the trimming device of FIG. 6.

As shown in FIG. 10, the rotary shaft 18 of the peeler wheel 140 extends in a sleeve 16. At the other end of the rotary shaft 18 opposite to the peeler wheel 14 is mounted a gear 20, which is connected to the power transmission system described with respect to the first embodiment.

The trimming device 80 of the second embodiment does the functions similar to those of the trimming device 8 of the first embodiment. It is to be noted that in the second embodiment, although the peeler wheel 140 has three openings 46, the surplus shredded tobacco is not discharged through the openings 46. More specifically, since the peeler wheel 140 rotates at high speed and each spoke 24 is formed to have a wedge-shaped profile as described above, the rotation of the spokes 24 generates an air flow flowing from the downstream side to the upstream side, relative to the transportation direction of the shredded tobacco layer through the openings 46, which prevents the surplus shredded tobacco from coming into the openings 46. The surplus shredded tobacco is subjected to the compressed air flow ejected from a nozzle 48, and discharged downward from the periphery of the peeler wheel 140.

In the above described embodiments, the axis of rotation C of the peeler wheel 14 or 140 extends in the direction intersecting the transport direction A of the shredded tobacco layer $T_{LO}$. However, the axis of rotation C may extend parallel to the transport direction A. In that case, only the plane of rotation of peeling blade 44 needs to intersect the shredded tobacco layer $T_{LO}$.

What is claimed is:

1. A device for trimming a shredded tobacco layer formed in a cigarette manufacturing machine, comprising:

a trimming disk rotatably arranged in a vicinity of a suction band which forms and transports the shredded tobacco layer, said trimming disk continuously cutting into the shredded tobacco layer during the rotation of said trimming disk, thereby dividing the shredded tobacco layer into a required layer portion and a surplus portion; and removing means for removing the surplus portion of the shredded tobacco layer in cooperation with said trimming disk, said removing means including scraping means for scraping the surplus portion off said trimming disk, said scraping means including a peeling blade arranged to move keeping contact with said trimming disk, and deflecting means for deflecting the scraped-off surplus portion of shredded tobacco in a direction deviating from said trimming disk, said deflecting means including air ejecting means for ejecting a compressed air flow to the scraped-off surplus portion of shredded tobacco.

2. The device according to claim 1, wherein said scraping means further includes a rotatable wheel member, said wheel member has an peripheral edge formed as said peeling blade, and said peeling blade extends continuously in a peripheral direction of said wheel member.

3. The device according to claim 2, wherein said air ejecting means includes an air nozzle disposed beside said wheel member, and said air nozzle ejects compressed air along a plane of rotation of said peeling blade.

4. The device according to claim 3, wherein said deflecting means further includes a guide surface formed at said wheel member to guide the scraped-off surplus portion of shredded tobacco.

5. The device according to claim 3, wherein said wheel member is provided with a plurality of openings which are disposed spaced apart from one another in the peripheral direction of said wheel member, and said deflecting means further includes means for generating an air flow flowing through the openings to the side of said peeling blade.

6. The device according to claim 2, wherein said peeling blade moves in a direction intersecting a transportation direction of the shredded tobacco layer when said wheel member rotates.

* * * * *